US012410806B2

(12) United States Patent
Wu et al.

(10) Patent No.: US 12,410,806 B2
(45) Date of Patent: Sep. 9, 2025

(54) FAN CONTROL METHOD, PROCESSING DEVICE, AND FAN CONTROL SYSTEM

(71) Applicant: Wiwynn Corporation, New Taipei (TW)

(72) Inventors: Chia-Chien Wu, New Taipei (TW); Ya-Hsuan Tseng, New Taipei (TW); Kai-Sheng Chen, New Taipei (TW)

(73) Assignee: Wiwynn Corporation, New Taipei (TW)

( * ) Notice: Subject to any disclaimer, the term of this patent is extended or adjusted under 35 U.S.C. 154(b) by 250 days.

(21) Appl. No.: 18/155,643

(22) Filed: Jan. 17, 2023

(65) Prior Publication Data

US 2024/0125329 A1 Apr. 18, 2024

(30) Foreign Application Priority Data

Oct. 13, 2022 (TW) ..... 111138910

(51) Int. Cl.
*F04D 27/00* (2006.01)
*F04D 25/06* (2006.01)
*F04D 25/16* (2006.01)

(52) U.S. Cl.
CPC ..... *F04D 27/004* (2013.01); *F04D 25/06* (2013.01); *F04D 25/166* (2013.01)

(58) Field of Classification Search
CPC ..... F04D 25/06; F04D 25/08; F04D 27/004; F04D 25/166; F05D 2270/303
See application file for complete search history.

(56) References Cited

U.S. PATENT DOCUMENTS 9,223,325 B2 * 12/2015 Hensley ..... G06F 1/206

FOREIGN PATENT DOCUMENTS

| | | | | |
|---|---|---|---|---|
| CN | 106151084 | | 11/2016 | |
| CN | 106151084 A | * | 11/2016 | ..... G06F 1/20 |
| CN | 107665028 | | 2/2018 | |
| CN | 107665028 A | * | 2/2018 | ..... F04D 27/004 |
| CN | 107882763 B | * | 2/2020 | ..... F04D 27/004 |

(Continued)

OTHER PUBLICATIONS

"How to Calculate Weighted Factors"; Carter McBride, Apr. 24, 2017; https://www.sciencing.com/calculate-weighted-factors-8156241/ (Year: 2017).*

(Continued)

*Primary Examiner* — Alexander B Comley
(74) *Attorney, Agent, or Firm* — JCIPRNET

(57) ABSTRACT

A fan control method, a processing device, and a fan control system are provided. The fan control method includes: obtaining at least one temperature-fan speed table and at least one current-fan speed table corresponding to each of at least one fan device; obtaining an estimated temperature value corresponding to a predetermined area according to a sensing result of at least one temperature sensor disposed in the predetermined area; obtaining rotational speed information of a target rotational speed of the at least one fan device according to the estimated temperature value and the at least one temperature-fan speed table; and providing the rotational speed information to a controller configured to control a fan speed in the at least one fan device.

14 Claims, 4 Drawing Sheets

(56) References Cited

FOREIGN PATENT DOCUMENTS

| | | | | | |
|---|---|---|---|---|---|
| CN | 111522421 | A | * | 8/2020 | ..... F04D 25/08 |
| CN | 112922866 | A | * | 6/2021 | ..... F04D 25/08 |
| CN | 113849055 | | | 12/2021 | |
| CN | 113849055 | A | * | 12/2021 | ..... F04D 27/004 |
| CN | 113931860 | A | * | 1/2022 | ..... F04D 25/08 |
| CN | 114320970 | A | * | 4/2022 | ..... F04D 25/08 |
| EP | 3795465 | A1 | * | 3/2021 | |
| TW | 201327117 | | | 7/2013 | |
| TW | 201327117 | A | * | 7/2013 | ..... G06F 11/3044 |

OTHER PUBLICATIONS

"Office Action of Taiwan Counterpart Application", issued on Aug. 9, 2023, p. 1-p. 9.

* cited by examiner

FAN CONTROL METHOD, PROCESSING DEVICE, AND FAN CONTROL SYSTEM

CROSS-REFERENCE TO RELATED APPLICATION

This application claims the priority benefit of Taiwan application serial no. 111138910, filed on Oct. 13, 2022. The entirety of the above-mentioned patent application is hereby incorporated by reference herein and made a part of this specification.

BACKGROUND

Technical Field

The disclosure relates to a control technology of an apparatus, and particularly relates to a fan control method, a processing device, and a control system thereof.

Description of Related Art

When managing a large number of storage or computing devices, fans in each device are also one of the key points of management. However, when a fan is faulty, maintenance personnel can only go to the site to replace the fan, but because there are too many fans, the maintenance personnel cannot accurately locate and manage these fans, nor can they know why some fans are frequently damaged or faulty.

On the other hand, in order to facilitate the management of the fans in the device, these fans are often controlled synchronously. However, due to different brands or versions of the fans, the output rotational speeds of the fans may not be the same. In order to prevent high ambient temperature, it is possible to increase the rotational speeds of all fans simultaneously, thereby causing waste of power and possibly affecting the performance of a hard disk due to the vibration of the fans with high rotational speeds. In addition, the vibration of the fans may cause resonance effect of other components (e.g., hard disk) in the device or other adverse effects, which affect the performance of other components.

SUMMARY

A fan control method of an embodiment of the disclosure includes the following steps. At least one temperature-fan speed table corresponding to each of at least one fan device is obtained. An estimated temperature value corresponding to a predetermined area is obtained according to a sensing result of at least one temperature sensor disposed in the predetermined area. Rotational speed information related to a target rotational speed of the at least one fan device is obtained according to the estimated temperature value and the at least one temperature-fan speed table. The rotational speed information is provided to a controller configured to control a fan speed in the at least one fan device.

A processing device of an embodiment of the disclosure is used for a fan control system. The processing device is configured to execute the following steps. At least one temperature-fan speed table respectively corresponding to at least one fan device is obtained. An estimated temperature value corresponding to a predetermined area is calculated according to at least one temperature sensor disposed in the predetermined area, a rotational speed information according to the temperature-fan speed table and the estimated temperature value are obtained, and the rotational speed information is provided to a controller in the at least one fan device, so that the controller controls a rotational speed of each of the at least one fan device in the predetermined area according to the rotational speed information.

A fan control system of an embodiment of the disclosure includes a processing device, at least one temperature sensor, multiple devices to be dissipated, and at least one fan device. The at least one temperature sensor is coupled to the processing device, and the at least one temperature sensor is disposed in a predetermined area. The devices to be dissipated are disposed in the predetermined area. The at least one fan device is coupled to the processing device and is configured to dissipate heat from the devices to be dissipated. Each fan device includes a controller and a memory device. The controller is configured to communicate with the processing device. The memory device is coupled to the processing device and is configured to store at least one preset data related to the at least one fan device. The processing device is configured to obtain the at least one preset data corresponding to the at least one fan device from the memory device, and obtain a temperature-fan speed table corresponding to each of the at least one fan device according to the at least one preset data.

In order to make the above-mentioned features and advantages of the disclosure more comprehensible, the following embodiments are given and described in detail with the accompanying drawings as follows.

DESCRIPTION OF THE EMBODIMENTS

Figure 1:
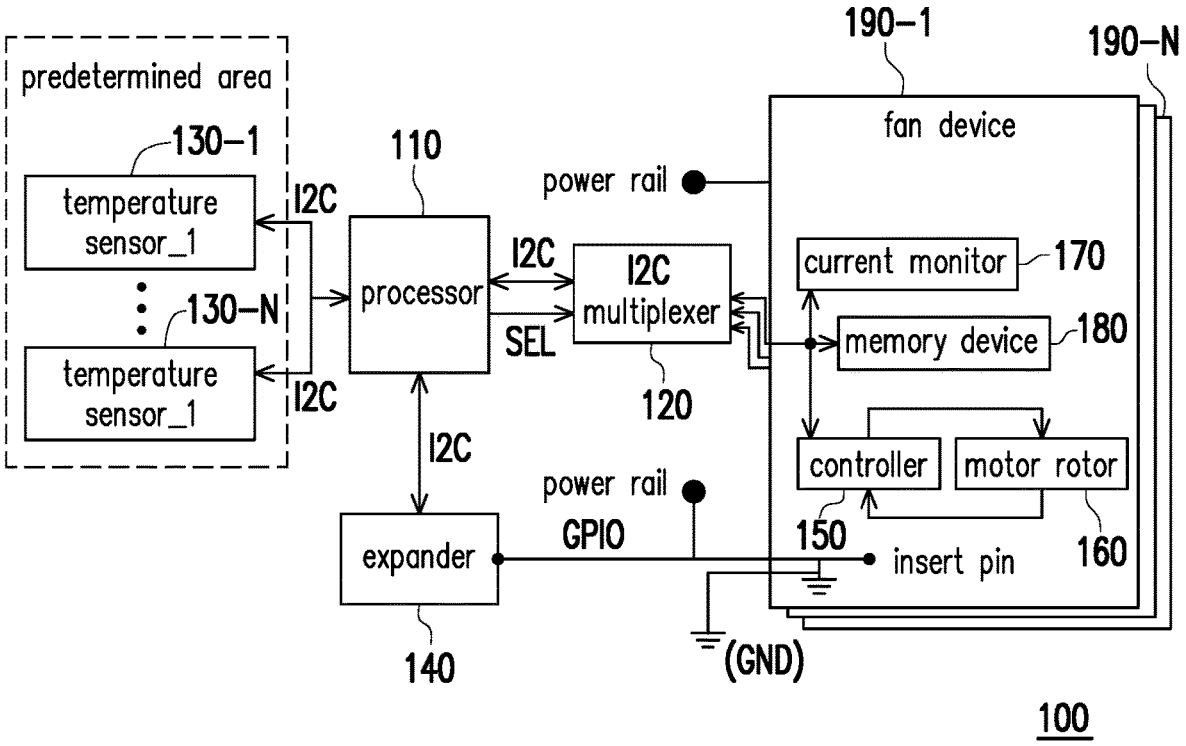
FIG. 1 is a schematic diagram of a fan control system according to an embodiment of the disclosure.

FIG. 1 is a schematic diagram of a fan control system 100 according to an embodiment of the disclosure. The fan control system 100 may be disposed in a large data center to manage fan devices of multiple computing devices. The fan control system 100 mainly includes a processing device (e.g., a processor 110 shown in FIG. 1), one or more temperature sensors (e.g., temperature sensors 130-1 to 130-N), one or more devices to be dissipated (e.g., heat generating such as HDDs), and one or more fan devices (e.g., fan devices 190-1 to 190-N). The processing device of the embodiment may be a host device, and the host device is provided with the processor 110 to implement the overall operation of the embodiment. The fan control system 100 may also include an inter-integrated circuit (I2C) multiplexer 120 and an expander 140.

For the convenience of description, the temperature sensor 130-1 and the fan device 190-1 in the fan control system 100 are described in detail here. Other temperature sensors and fan devices can be implemented by respectively referring to the temperature sensor 130-1 and the fan device 190-1.

The fan device 190-1 may include a controller 150, a motor rotor 160, a current monitor 170, a memory device 180, and multiple pins.

The memory device 180 may be an electrically erasable programmable read only memory (EEPROM) and is used to record relevant preset data of a fan during a production process and of a factory batch. The preset data may include manufacturer information, factory serial number (SN), date code, electrical characteristics, hardware/firmware version, rotational speed table, etc. The rotational speed table includes, for example, a temperature-fan speed table and a current-fan speed table. Those who apply the embodiment may adjust the content of the aforementioned data according to requirements, and the embodiment of the disclosure is not limited to the aforementioned examples of the data.

The pins may be used for the following requirements: power rail, I2C, insert pin, and ground (GND). The pin for power rail is used to supply required power for each circuit and the motor rotors 160 in the fan device. I2C uses pins of two signal lines (i.e., a serial clock line, SCL and a serial data line, SDA) as bridges for signal interface communication between the controller 150, the memory device 180, the current monitor 170, and the processor 110. The insert pin is used for the processor 110 to determine whether a fan is installed at a position through a change in high/low potential of the pin. The ground pin f is used for grounding.

Figure 2:
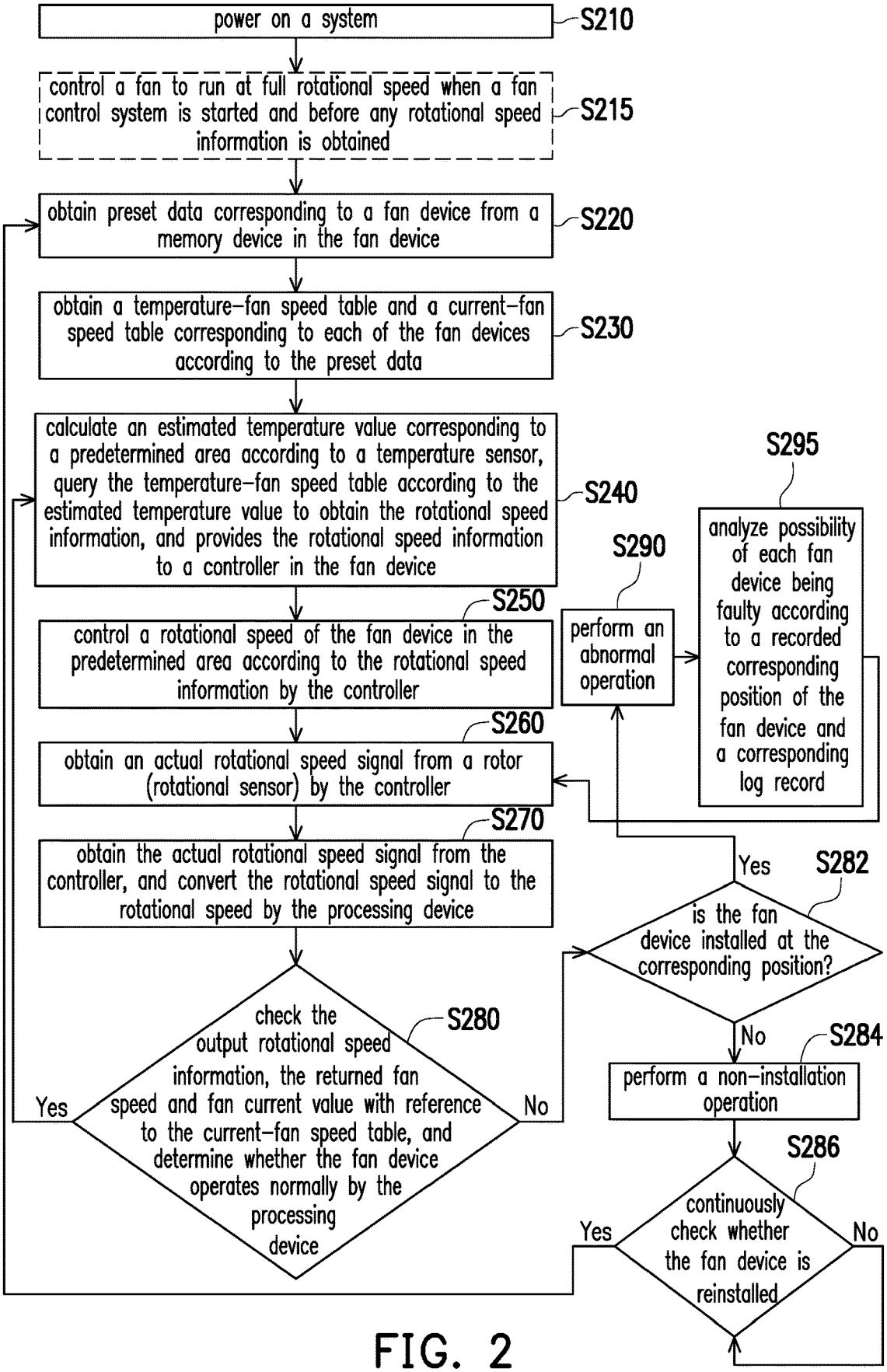
FIG. 2 is a flowchart of a fan control method according to an embodiment of the disclosure.

FIG. 2 is a flowchart of a fan control method according to an embodiment of the disclosure. The fan control method of FIG. 2 may be implemented by applying the fan control system 100 of FIG. 1. Please refer to FIG. 1 and FIG. 2 at the same time. In Step S210, an electronic system with the fan control system 100 is powered on. The electronic system may be a controlling device and a corresponding controlled electronic device in a large data center.

In Step S215, when the fan control system 100 is started and before any rotational speed information is obtained, the fan device 190-1 is controlled to run at full rotational speed. In other words, since the fan device 190-1 has not obtained any rotational speed information from the processor 110 when the electronic system is powered on, the motor rotors 160 of the fan device 190-1 operate at a preset rotational speed, and the preset rotational speed may be running at full speed.

In Step S220, the processor 110 obtains preset data corresponding to the fan device 190-1 from the memory device 180 of the fan device 190-1. In detail, the processor 110 may be connected to the fan device 190-1 through the I2C multiplexer 120, and the processor 110 may control the I2C multiplexer 120 through a fan device selection signal SEL, so as to selectively read fan information from the memory device 180 in the fan device (e.g., the fan device 190-1) to be processed. The fan information includes a temperature-fan speed table, a current-fan speed table, brand or factory version corresponding to the fan device 190-1, etc. The temperature-fan speed table may indicate the correspondence between a range of current temperature and a control signal (e.g., pulse-width modulation signal, PWM signal) required for the fan device 190-1. The current-fan speed table may indicate the correspondence between current received by the fan device 190-1, an actual rotational speed returned by the fan device 190-1, and a PWM signal received by the fan device 190-1.

In Step S230, the processor 110 obtains the temperature-fan speed table and the current-fan speed table corresponding to each of the fan devices according to the preset data. The preset data in the embodiment may include the temperature-fan speed table, the current-fan speed table, the brand or factory version corresponding to the fan device 190-1, etc. After reading the preset data, the processor 110 records the fan information of the fan devices at respective positions in the fan control system 100. In the embodiment, Table 1-1 to Table 1-3 are used as examples of the fan devices of different brands or versions. Although the fan devices of Table 1-1 and Table 1-2 are both of a first brand, the temperature-fan speed tables are different because of different versions.

TABLE 1-1

| Category | Temperature range (° C.) | First brand (version 1) PWM signal Required (%) |
|---|---|---|
| 1 | 0~35 | 20 |
| 2 | 35~45 | 40 |
| 3 | 45~55 | 60 |
| 4 | 55~65 | 80 |
| 5 | 65 or more | 100 |

TABLE 1-2

| Category | Temperature range (° C.) | First brand (version 2) PWM signal Required (%) |
|---|---|---|
| 1 | 0~35 | 25 |
| 2 | 35~45 | 45 |
| 3 | 45~55 | 65 |
| 4 | 55~65 | 85 |
| 5 | 65 or more | 100 |

TABLE 1-3

| Category | Temperature range (° C.) | Second brand (version 2) PWM signal Required (%) |
|---|---|---|
| 1 | 0~35 | 18 |
| 2 | 35~45 | 38 |
| 3 | 45~55 | 58 |
| 4 | 55~65 | 78 |
| 5 | 65 or more | 100 |

In addition to recording the fan information of the fan devices at respective positions in the fan control system 100, the processor 110 may also obtain the temperature-fan speed tables from the fan devices, without storing in the processor 110, thereby reducing the amount of data in the processor 110. In another embodiment according to the disclosure, the processor 110 may also store the temperature-fan speed tables of each brand and each version. When converting the temperature and the fan speed, there is no need to obtain the temperature-fan speed table through the fan device, thereby reducing the workload of the processor 110 when accessing data from the fan device. The disclosure does not limit the manner in which the processor 110 accesses data.

In Step S240, the processor 110 calculates an estimated temperature value corresponding to a predetermined area according to the temperature sensor 130-1 in the predetermined area of each computing device, queries the temperature-fan speed table according to the estimated temperature value to obtain the rotational speed information, and provides the rotational speed information to a controller (e.g., the controller 150) in the fan device (e.g., the fan device 190-1). Specifically, an internal sensing result is transmitted from the temperature sensor 130-1 to the processor 110 through an I2C interface, and the sensing result is, for example, a temperature reading. The processor 110 converts a temperature obtained from the temperature sensor 130-1 through Table 1-1 to Table 1-3 to obtain corresponding rotational speed information. The rotational speed information is, for example, a PWM signal required (%). For details of Step S240, please refer to corresponding descriptions of FIG. 3 and FIG. 4 below.

Figure 3:
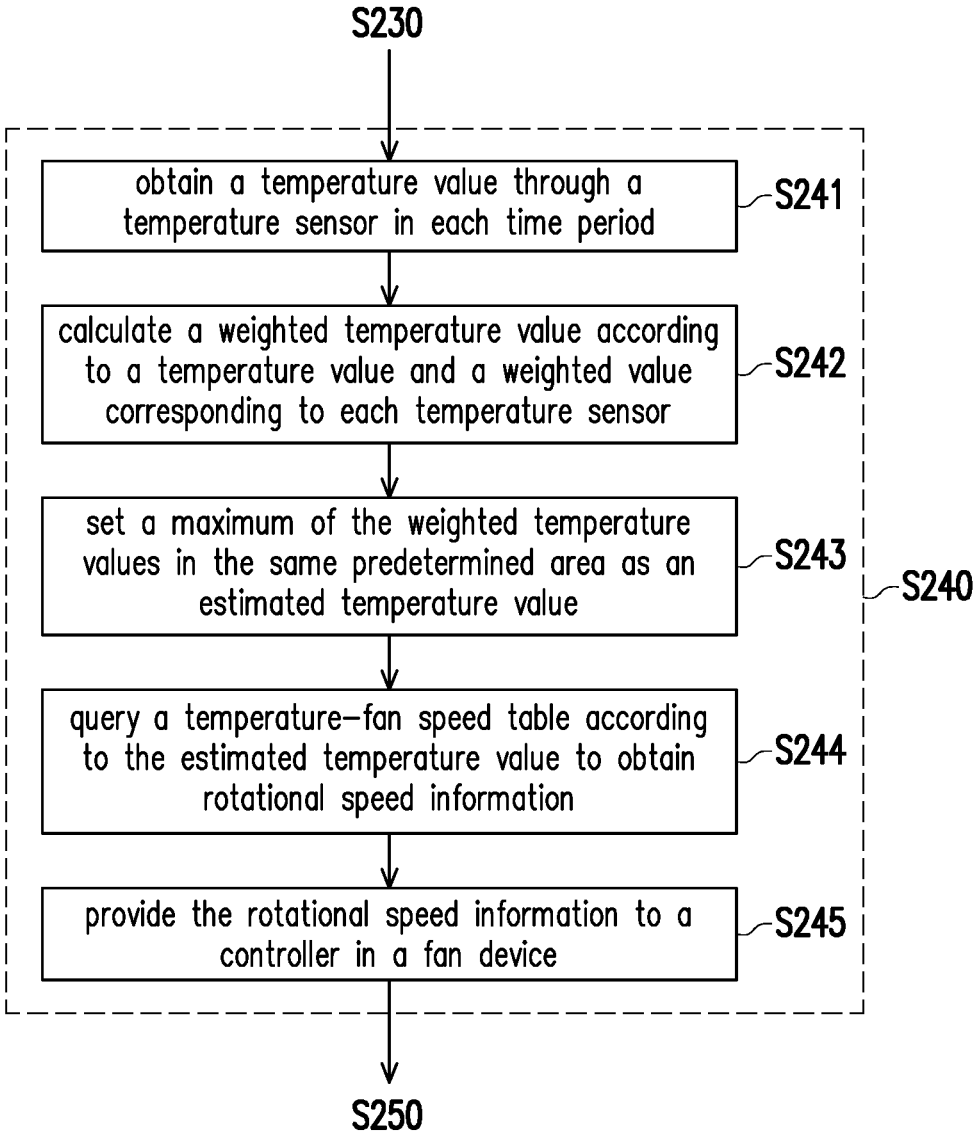
FIG. 3 is a detailed operation flowchart of S240 in FIG. 2.
Figure 4:
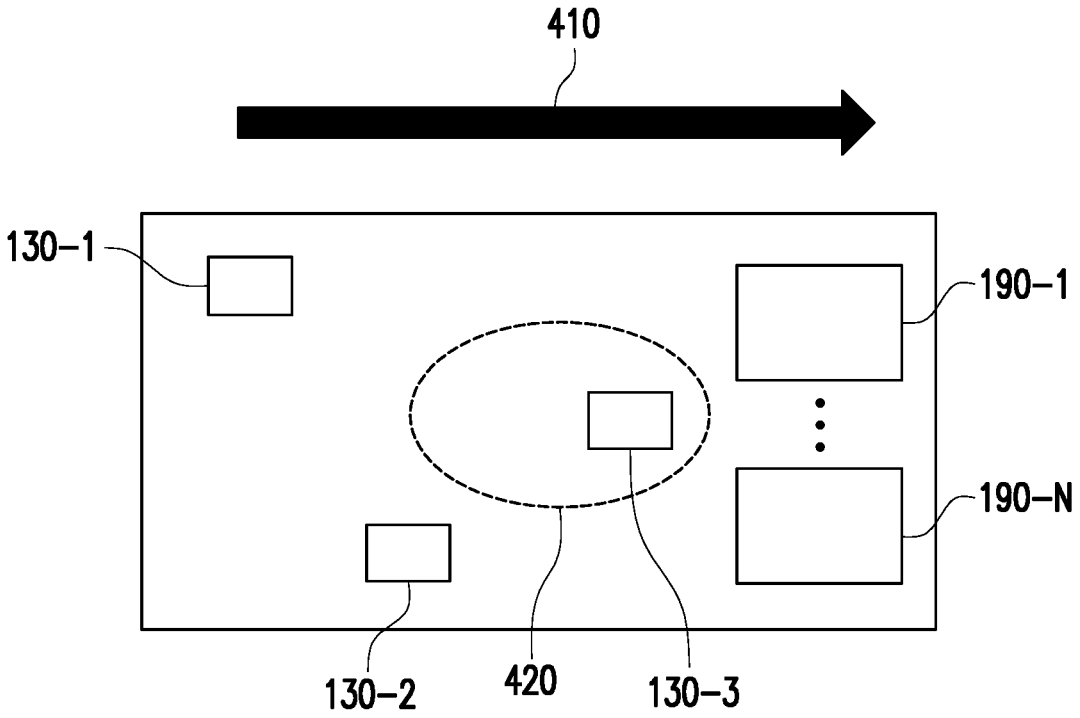
FIG. 4 is a schematic diagram of an example of a configuration position of a temperature sensor in a predetermined area and weighting of a temperature reading according to an embodiment of the disclosure.

FIG. 3 is a detailed operation flowchart of S240 in FIG. 2. FIG. 4 is a schematic diagram of an example of a configuration position of a temperature sensor in a predetermined area and weighting of a temperature reading according to an embodiment of the disclosure. Please refer to FIG. 4 first. FIG. 4 is an example of the configuration position of the temperature sensor in the predetermined area in the embodiment. The predetermined area in FIG. 4 includes the configuration positions of multiple temperature sensors, such as the temperature sensor 130-1, a temperature sensor 130-2, and a temperature sensor 130-3. The predetermined area may also include configuration positions of the fan devices 190-1 to 190-N. The temperature sensor 130-3 of the embodiment is installed in an area 420 where an area temperature is relatively high, and an airflow direction is shown as 410.

Please refer to FIG. 3 and FIG. 4 at the same time. In Step S241, the processor 110 obtains multiple temperature values respectively through the temperature sensor 130-1, the temperature sensor 130-2, and the temperature sensor 130-3 in each time period. Each time period may be to read a value from the temperature sensor one time per minute. In Step S242, the processor 110 calculates multiple weighted temperature values according to the temperature values and multiple weighted values corresponding to the temperature sensors. The weighted value in the embodiment is related to a heat dissipation efficiency parameter and a temperature tolerance parameter of at least one component adjacent to each temperature sensor. For example, in the embodiment, parameters of each temperature sensor are recorded in Table 2 as follows.

TABLE 2

| Temperature sensor | Category of adjacent component | Heat dissipation efficiency parameter | Temperature tolerance parameter | Weighted value |
|---|---|---|---|---|
| 130-1 | baseboard management controller | 45/60 = 0.75 | (60 × 1.1)/85 = 0.78 | 0.75 × 0.78 = 0.58 |
| 130-2 | hard disk | 60/60 = 1.0 | (60 × 1.1)/70 = 0.94 | 1.0 × 0.94 = 0.94 |
| 130-3 | passive component | 55/60 = 0.92 | (60 × 1.1)/125 = 0.53 | 0.92 × 0.53 = 0.48 |

In the embodiment, the weighted value of the temperature sensor may be a product of the heat dissipation efficiency parameter of the corresponding component multiplied by the temperature tolerance parameter of the corresponding component. The heat dissipation efficiency (HDE) parameter may be a quotient value of a temperature at a position where the corresponding temperature sensor is at divided by a system predetermined maximum temperature value (e.g., a predetermined upper limit for system temperature). The temperature tolerance parameter (also referred to as a temperature specification maximum, TSM) may be a quotient value obtained by first multiplying the system predetermined maximum temperature value by a derating parameter, and then dividing by a component predetermined maximum temperature value (e.g., a predetermined upper limit for component temperature). The derating parameter in the embodiment is set to 1.10. Persons applying the embodiment can adjust calculation manners of the parameters according to requirements.

The temperature tolerance range of each component in the embodiment may be shown in Table 3 as follows.

TABLE 3

| Component category | Minimum temperature tolerance (° C.) | Maximum temperature tolerance (° C.) |
|---|---|---|
| baseboard management controller | −45 | 85 |
| hard disk | 0 | 70 |
| passive component | −55 | 125 |

The maximum temperature tolerance (° C.) is the component predetermined maximum temperature value.

In Step S243, the processor 110 sets a maximum value among the weighted temperature values of the temperature sensors located in the same predetermined area as the estimated temperature value. In Step S244, the processor 110 queries the temperature-fan speed table according to the estimated temperature value, as shown in Table 1-1 to Table 1-3, to obtain the rotational speed information. Assuming that brand information is known from the preset data of the fan device as the first brand (version 2), and the estimated temperature value is 55° C., the processor 110 obtains the rotational speed information of 65%. In Step S245, the rotational speed information is provided to the controller in the fan device. Specifically, the processor 110 outputs the rotational speed information to the fan device through the I2C interface.

Referring to FIG. 2 again, in Step S250, the controller 150 in the fan device 190-1 uses the rotational speed information from the processor to output the PWM signal to the motor rotor 160, thereby controlling the rotational speed of each of the fan devices in the predetermined area, so as to dissipate heat from the devices to be dissipated in the predetermined area. In Step S260, the controller 150 obtains an actual rotational speed signal from a rotor (rotational sensor). In other words, the controller 150 obtains a rotational speed signal of the motor rotor 160. Afterward, in Step S270, the processing device obtains the actual rotational speed signal from the controller, and converts the rotational speed signal into a rotational speed. In other words, after the processor 110 obtains the rotational speed signal from the controller 150, and then converts the rotational speed signal to the rotational speed through a rotational speed signal-rotational speed table or a formula (for example, the rotational speed (rpm) is equal to a quotient of the rotational speed signal (TACH) divided by a constant (COUNT), as shown in Formula 1). The current-fan speed table of the embodiment is obtained from the preset data, and current values corresponding to fan devices of different brands may be integrated with reference to the rotational speed table according to requirements of persons applying the embodiment. The current value may be expressed as an average current signal (A). A user of the embodiment may adjust the expression of the current value, including but not limited to a maximum current signal, an average current signal, and a minimum current signal, according to actual requirements. In the embodiment, the current-fan speed table for the fan device 190-1 is shown in Table 4.

TABLE 4

| PWM duty cycle | Fan speed (rpm) signal | Average current signal (A) |
|---|---|---|
| 100 | 13000 ± 10% | 2.90 |
| 70 | 9450 ± 10% | 1.40 |

TABLE 4-continued

| PWM duty cycle | Fan speed (rpm) signal | Average current signal (A) |
|---|---|---|
| 50 | 7150 ± 10% | 0.70 |
| 20 | 3650 ± 10% | 0.20 |
| 0 | 1300 ± 15% | 0.06 |

$$\text{Rotational speed (rpm)} = \frac{\text{rotational speed signal (TACH)}}{\text{constant (COUNT)}} \quad \text{Formula 1}$$

In Step S280, the processing device checks the output rotational speed information and the returned fan speed and fan current value with reference to the current-fan speed table, and determines whether the fan device operates normally. Specifically, the processor 110 determines whether the at least one fan device (e.g., the fan device 190-1) operates normally by using the current value obtained from the current monitor in Step S270 and the rotational speed returned and converted from the controller of the fan device 190-1. For example, the embodiment uses RPM or a corresponding signal to present the rotational speed of the fan device 190-1. If the fan device operates normally, that is, the processor 110 checks whether the RPM and the current value returned by the fan device both match Table 4 according to the rotational speed information, and if the RPM and the current value match Table 4, return to Step S240 and the processor 110 continues to monitor the fan device. If the fan device does not operate normally, that is, as long as the RPM or the current value returned by the fan device does not match Table 4, go to Step S282.

In Step S282, the processor 110 selectively detects a pin of a specific fan device with general-purpose input/output (GPIO) through the expander 140 to determine whether the fan device is installed at a corresponding position.

If the fan device (e.g. the fan device 190-1) does not operate properly but is installed correctly, go to Step S290, and an abnormal operation is executed. The abnormal operation includes, for example, recording the corresponding position of the at least one fan device operating abnormally and a corresponding log record through the processor. In some embodiments, the abnormal operation further includes enhancing the rotational speed of other fan devices, so that even if the detected fan does not operate normally (e.g., does not rotate), the other undetected fans can still maintain the overall heat dissipation effect. In some embodiments, the abnormal operation further includes disconnecting the power supply of the fan operating abnormally (e.g., excessive current or fan speed). Afterward, Step S295 is performed. In Step S295, the processor 110 analyzes whether a (e.g., previously occurred) relevant abnormal behavior of the fan device has been recorded according to the recorded corresponding position of the fan device and the corresponding log record. In addition, the processor 110 also traces whether there is a possibility of the fans of the same batch being faulty through the fan factory serial number recorded in the memory device 180 in the fan device. In the illustrated embodiment, after Step S295 is executed, return to Step S260 and continue monitoring.

Referring to Step S282 again, if the fan device is not installed at the corresponding location, go to Step S284. In Step S284, a non-installation operation is performed. Specifically, because the processor 110 determines that the fan device 190-1 is not operating normally and is not installed correctly, the processor 110 performs the non-installation operation. At this time, the processor 110 records the position corresponding to the abnormally functioning fan device and the corresponding log record, and sends enhanced heat dissipation operation signals to fans at other positions. After the fan device receives the enhanced heat dissipation operation signal, the processor 110 controls the normally operating fan device to increase the rotational speed to operate (for example, at the full rotation speed). In some embodiments, the processor 110 further continuously checks whether the fan device is reinstalled (i.e., Step S286). In the illustrated embodiment, if the fan device has been reinstalled, return to Step S220 and the processor 110 continues to monitor; and if the fan device has not been reinstalled, Step S286 is repeated continuously.

To sum up, in the disclosure, through adding the controller and the memory device to the fan device, the fan speed can be adjusted correspondingly for a single fan device based on changes in ambient temperature and information about adjacent fans. At the same time, by detecting the occurrence of abnormal behavior, whether the installation is normal or whether the fan is operating abnormally can also be determined, so as to respond differently. Further, through the abnormal operation of the fan, it is possible to trace whether the fan with the same serial number also has the same or similar abnormal operation record, so as to further repair or update the fan in advance to prevent the possibility of abnormal operation in the future. Through the above, the effect of preventing excessive energy consumption of the fan and the effect of preventing the performance of the storage device from being reduced due to the vibration of the fan with high rotational speed can be achieved. In addition, the vibration of the fan device may cause resonance effect of other components (e.g., hard disk, etc.) in the device or other adverse effects, which affect the performance of other components. To prevent the aforementioned situation, in the embodiment, the rotational speeds of the fan devices in some areas can be adjusted selectively.

What is claimed is:

1. A fan control method, comprising:

obtaining at least one temperature-fan speed table corresponding to each of at least one fan device;

obtaining an estimated temperature value corresponding to a predetermined area according to a sensing result of at least one temperature sensor disposed in the predetermined area;

obtaining rotational speed information related to a target rotational speed of the at least one fan device according to the estimated temperature value and the at least one temperature-fan speed table; and providing the rotational speed information to a controller configured to control a fan speed in the at least one fan device, wherein the step of obtaining the estimated temperature value comprises:

obtaining at least one temperature value through the at least one temperature sensor in one time period;

calculating at least one weighted temperature value according to the at least one temperature value and a weighted value corresponding to each of the at least one temperature sensor; and using a maximum of the at least one weighted temperature value corresponding to the same predetermined area as the estimated temperature value, wherein the weighted value is related to a heat dissipation efficiency parameter and a temperature tolerance parameter of at least one component adjacent to each of the at least one temperature sensor.

2. The fan control method according to claim 1, wherein the weighted value is a product of the heat dissipation efficiency parameter multiplied by the temperature tolerance parameter.

3. The fan control method according to claim 1, wherein the heat dissipation efficiency parameter is a quotient value of a temperature at a position where each of the corresponding at least one temperature sensor is at divided by a system predetermined maximum temperature value, and the temperature tolerance parameter of the at least one component is a quotient value obtained by multiplying the system predetermined maximum temperature value by a derating parameter, and then dividing by a component predetermined maximum temperature value.

4. The fan control method according to claim 1, further comprising:

obtaining a rotational speed of the at least one fan device and a current value of the at least one fan device, determining whether the at least one fan device operates normally according to the rotational speed and the current value;

detecting whether the at least one fan device is installed at a corresponding position for installing the at least one fan device when the at least one fan device does not operate normally;

performing an enhanced heat dissipation operation on ether at least one normally operating at least one fan device when the at least one fan device does not operate normally and the at least one fan device is not installed at the corresponding position; and performing an abnormal operation when the at least one fan device does not operate normally and the at least one fan device is installed at the corresponding position.

5. The fan control method according to claim 4, further comprising recording the corresponding position of the abnormally operating at least one fan device and a corresponding log record through a processor when the at least one fan device does not operate normally and the at least one fan device is not installed at the corresponding position, wherein the enhanced heat dissipation operation comprises controlling the other normally operating at least one fan device to operate at a preset rotational speed through the processor, wherein the abnormal operation comprises recording the corresponding position of the abnormally operating at least one fan device and the corresponding log record.

6. The fan control method according to claim 4, wherein the step of determining whether the at least one fan device operates normally comprises:

obtaining a current-fan speed table corresponding to each of the at least one fan device; and determining whether the at least one fan device operates normally according to the current-fan speed table, the rotational speed information and a current signal, wherein the current signal expresses the current value.

7. A processing device for a fan control system, wherein the processing device is configured to execute following steps of:

obtaining a temperature-fan speed table corresponding to each of at least one fan device;

calculating an estimated temperature value corresponding to a predetermined area according to at least one temperature sensor disposed in the predetermined area, obtaining rotational speed information according to the temperature-fan speed table and the estimated temperature value, and providing the rotational speed information to a controller in the at least one fan device, so that the controller controls a fan speed of each of the at least one fan device in the predetermined area according to the rotational speed information, wherein the processing device is further configured to execute following steps of:

obtaining at least one temperature value through the at least one temperature sensor in one time period;

calculating at least one weighted temperature value according to the at least one temperature value and a weighted value corresponding to each of the at least one temperature sensor; and using a maximum of the at least one weighted temperature value located in the same predetermined area as the estimated temperature value, wherein the weighted value is related to a heat dissipation efficiency parameter and a temperature tolerance parameter of at least one component adjacent to each of the at least one temperature sensor.

8. The processing device according to claim 7, wherein the weighted value is a product of the heat dissipation efficiency parameter multiplied by the temperature tolerance parameter of the at least one component.

9. The processing device according to claim 7, wherein the heat dissipation efficiency parameter of the at least one component is a quotient value of a temperature at a position where each of the corresponding at least one temperature sensor is at divided by a system predetermined maximum temperature value, and the temperature tolerance parameter is a quotient value obtained by multiplying the system predetermined maximum temperature value by a derating parameter, and then dividing by a component predetermined maximum temperature value.

10. The processing device according to claim 7, further configured to execute following steps of:

obtaining a rotational speed of the at least one fan device and a current value of the at least one fan device from each of the at least one fan device;

determining whether the at least one fan device operates normally according to the rotational speed and the current value;

detecting whether the at least one fan device is installed at a corresponding position for installing the at least one fan device when the at least one fan device does not operate normally;

performing an enhanced heat dissipation operation on ether at least one normally operating at least one fan device when the at least one fan device does not operate normally and the at least one fan device is not installed at the corresponding position; and performing an abnormal operation when the at least one fan device does not operate normally and the at least one fan device is installed at the corresponding position.

11. A fan control system, comprising: the processing device according to claim 7; the at least one temperature sensor, coupled to the processing device, wherein the at least one temperature sensor is disposed in the predetermined area; a plurality of devices to be dissipated, disposed in the predetermined area; and the at least one fan device, coupled to the processing device and configured to dissipate heat from the plurality of devices to be dissipated, wherein each of the at least one fan device comprises: a controller, configured to communicate with the processing device; and a memory device, coupled to the processing device and configured to store at least one preset data related to the at least one fan device, wherein the processing device is configured to obtain the at least one preset data corresponding to the at least one fan device from the memory device, and obtain a temperature-fan speed table corresponding to each of the at least one fan device according to the at least one preset data.

12. The fan control system according to claim 11, wherein each of the at least one fan device further comprises:

a motor rotor, coupled to the controller, wherein the controller is configured to provide a rotational speed signal corresponding to the motor rotor to the processing device.

13. The fan control system according to claim 11, wherein the processing device and the at least one temperature sensor communicate with each other through inter-integrated circuit (I2C), and the processing device and the at least one fan device communicate with each other through an I2C multiplexer.

14. The fan control system according to claim 11, wherein the at least one fan device further comprises:

an insert pin, used to determine whether the at least one fan device is installed at a corresponding position.

* * * * *